United States Patent [19]

Morellini

[11] Patent Number: 4,682,716

[45] Date of Patent: Jul. 28, 1987

[54] GRIPPING APPARATUS

[76] Inventor: Peter Morellini, P.O. Box 188, Ingham, Queensland 4850, Australia

[21] Appl. No.: 774,590

[22] PCT Filed: Dec. 19, 1984

[86] PCT No.: PCT/AU84/00261

§ 371 Date: Aug. 13, 1985

§ 102(e) Date: Aug. 13, 1985

[87] PCT Pub. No.: WO85/02807

PCT Pub. Date: Jul. 4, 1985

[30] Foreign Application Priority Data

Dec. 19, 1983 [AU] Australia ..... PG2901

[51] Int. Cl.[4] ..... B67D 3/00

[52] U.S. Cl. ..... 222/529; 222/1; 242/107.6; 294/19.1; 251/4

[58] Field of Search ..... 222/1, 544, 529, 105; 242/107.6; 119/153; 294/19.1; 251/4, 7

[56] References Cited

U.S. PATENT DOCUMENTS

| | | | |
|---|---|---|---|
| 1,017,010 | 2/1912 | McNair et al. | 242/107.6 |
| 1,623,774 | 4/1927 | Bell | 119/153 |
| 1,964,631 | 6/1934 | Hansen | 119/153 |
| 1,977,504 | 10/1934 | Brown | 251/7 |
| 2,632,609 | 3/1953 | Kirby | 242/107.6 |
| 3,374,929 | 3/1968 | Silfverskiold | 222/105 |
| 3,693,596 | 9/1972 | Croce et al. | 242/107.6 |
| 3,949,514 | 4/1976 | Ramsey | 119/153 |

FOREIGN PATENT DOCUMENTS

| | | |
|---|---|---|
| 44182/79 | 8/1979 | Australia . |
| 667585 | 11/1938 | Fed. Rep. of Germany . |
| 1271649 | 6/1968 | Fed. Rep. of Germany . |
| 390831 | 8/1965 | Switzerland . |
| 1307297 | 2/1973 | United Kingdom . |

OTHER PUBLICATIONS

A Catalogue of Surgical Instruments, by Allen et al, pp. 260–261, 280–281, 1953 Edition.

*Primary Examiner*—H. Grant Skaggs Jr.
*Attorney, Agent, or Firm*—Murray Schaffer

[57] ABSTRACT

Apparatus for association with a container of the type having a flexible discharge spout, the apparatus including an elongated support, a spring loaded reel and a line wound on the reel and fixed to the support to form a loop which is placed about the spout. A pawl and ratchet assembly are associated with the reel such that when the pawl is engaged, the reel will wind in the line to reduce the size of the loop to constrict the discharge outlet of the container.

3 Claims, 3 Drawing Figures

GRIPPING APPARATUS

TECHNICAL FIELD

This invention relates to gripping apparatus which in one aspect is applicable to the control of discharge of granular type materials from flexible containers such as bags containing fertiliser.

BACKGROUND ART

It is common to market fertiliser in bags formed of flexible material such as woven plastics material or hessian type material. One form of fertiliser bag presently available includes an opening at its lower end so that an integrally formed or attached spout which is normally folded back into the bag can be extended out of the bag when fertiliser is required to be obtained from the bag. Normally the spout is formed of a fabric material and in use it is very difficult to control or shut off the output of the fertiliser therethrough. In some instances, control of output is attempted by use of the hands to throttle the spout whilst in other instances, a cord or rope is tied about the spout and tightened so that discharge of material can be regulated. These known methods however make the control of the discharge from the spout very difficult and in many instances, wastage occurs.

DISCLOSURE OF INVENTION

The present invention aims to overcome or alleviate at least some of the above disadvantages by providing gripping apparatus which is particularly useful for the control of discharge of materials from flexible containers of the above type. The present invention, however, is also suitable for many other applications where it is necessary to grasp an object by using a loop which is tightened about the object.

With the above and other objects in view, this invention resides broadly in gripping apparatus including support means, a flexible member associated with said support means and defining a loop adapted to be disposed about an object to be gripped; biasing means supported on said support means and operatively associated with said flexible member, release means associated with said biasing means and selectively operable to release said biasing means to apply a force to said flexible member to reduce the size of said loop and thereby grip said object.

BRIEF DESCRIPTION OF DRAWINGS

In order that the invention may be more readily understood and put into practical effect, reference will now be made to the accompanying drawings which illustrate a preferred embodiment of the invention and wherein.

BEST MODE OF CARRYING OUT THE INVENTION

Figure 1:
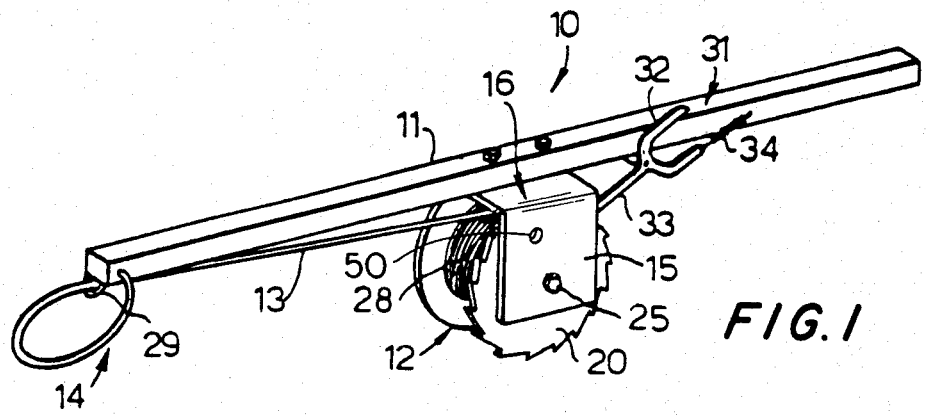
FIG. 1 illustrates in perspective view the apparatus of the present invention.
Figure 2:
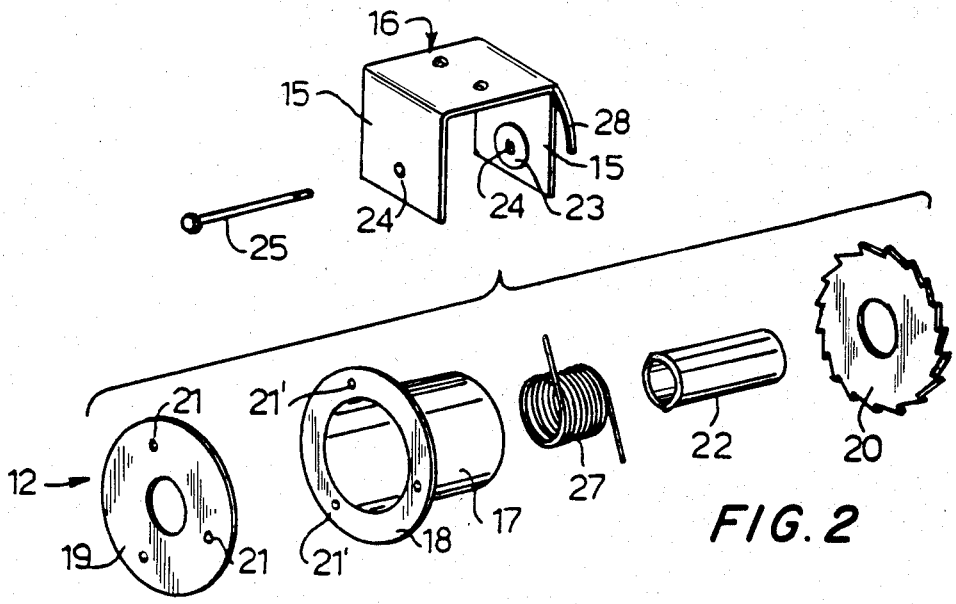
FIG. 2 is an exploded perspective view showing the components of the reel assembly of the apparatus shown in FIG. 1.

Referring to the drawings and firstly to FIG. 1 and FIG. 2 there is illustrated gripping apparatus 10 according to one form of the present invention including an elongated supporting member 11, a reel assembly 12 supported rotatably on the supporting member 11 and a flexible cable, wire, rope or the like 13 which is wound about the reel assembly 12 and which defines a loop 14 adapted to be located about an object to be gripped. The reel assembly 12 is supported rotatably between the respective arms 15 of a U-shaped bracket 16 which is fixed to the elongated supporting member intermediate its ends.

As shown more clearly in FIG. 2, the reel assembly 12 comprises a reel or main cylindrical member 17 such as a short length of pipe about which the length of cable or rope 13 is arranged to be wound having an annular flange 18 at one end thereof. The annular flange 18 is adapted to be mated with a centrally apertured circular disc-like member 19 whilst the other end of the cylindrical member 17 is arranged to be connected to a centrally apertured ratchet wheel 20 preferably by welding.

Preferably, the annular flange 18 and member 19 are provided with corresponding apertures 21 and 21' respectively for receipt of fasteners therethrough so that the member 19 may be releasably attached to the flange 18 to allow access to the interior of the member 17. The apertures in the circular member 19 and ratchet wheel 20 are sized to freely locate about a further small diameter cylindrical member 22 which comprises the axle of the reel assembly 12 and which in use is arranged to extend between the respective arms 15 of the U-shaped bracket 16. Preferably the axle 22 is located in correct position between the arms 15 by engagement over a washer 23 which is fixed to at least one arm 15 and located coaxially with a bolt-receiving aperture 24 therein. In use, a bolt 25 is passed through the respective apertures 24 in the arms 15 and the axle member 22 engaged with a nut 26 and tightened so that the axle member 22 is sandwiched between the bracket arms 15 and prevented from rotation. A coil spring 27 is arranged in the annular space between the axle member 22 and the member 17 and connected at one end to the member 17 and at its other end to the axle 22. Thus rotation of the reel assembly 12 about the axle 22 in one direction causes the spring 27 to be tensioned and a biasing force to be applied to the reel assembly 12 to rotate in the opposite direction. Preferably the bracket 16 is provided with an arcuate guard 28 which partly covers the teeth of the ratchet wheel 20 for safety purposes.

The cable or rope 13 is fixed at one end to the cylindrical member 17, wound thereabout, passed at its other end through an eye 29 located at one end of the member 11 and then back to be fixed to the end of the member 11 to define the loop 14.

A manually actuable pawl assembly 31 is supported on the elongated member 11 for engagement with the ratchet wheel 20. The pawl assembly 31 is pivotally mounted for movement about an axis parallel to the axis of the reel assembly and includes a manually depressable portion 32, a pawl finger 33, and a biasing spring 34 arranged to normally bias the pawl finger 33 into an engaged attitude.

The spring 27 is preloaded so that when the pawl assembly 31 is actuated to release the ratchet wheel 20, the bias of the spring 27 will cause the reel assembly 12 to rotate thereby to wind up the cable 13 and reduce the loop 14 to its minimum size.

Figure 3:
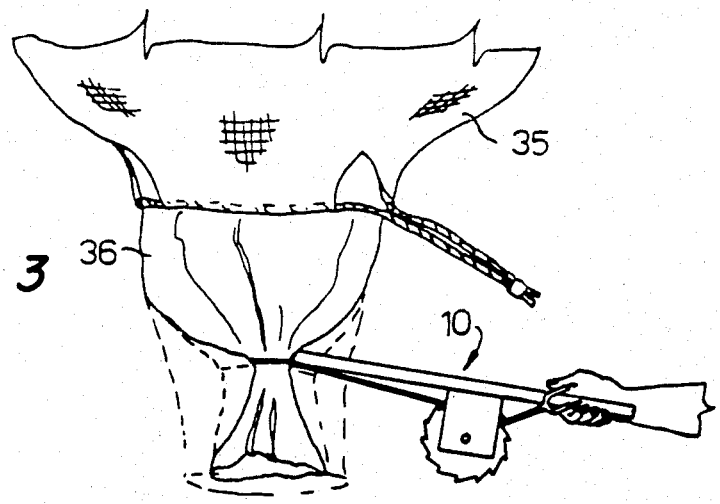
FIG. 3 illustrates the apparatus of the present invention associated with a flexible container to control the discharge of materials therefrom.

Referring now to FIG. 3, there is illustrated a flexible container 35 for granular fertilizer material having a discharge spout 36 which is controlled by the apparatus 10 of the present invention. In use, the container 35 is normally supported by a crane at the front or rear of a prime mover such as a tractor and above the bin of a fertilizer distributor so that fertilizer can be deposited thereinto from the container 35. The spout 36 is initially folded back into the container 35; however, when material is required from the container, the spout is released and untied. Using the present invention and before the spout is untied the loop 14 is increased in size by simply pulling the cable or rope 13 from the reel assembly 12, thus causing the reel assembly 12 to rotate against the bias of the spring 27 and the pawl finger 33 to ride up over the teeth of the ratchet wheel 20. The loop 14 is made large enough so that it can be passed about the spout 36 and the pawl assembly 31 may be actuated by an operator who grips the elongated member 11 as shown and depresses the portion 32. The spout may be then untied so that material will then discharge therefrom; however, provided the pawl assembly 31 remains actuated, the reel assembly 12 will wind in the cable or rope 13 to reduce the size of the loop to rapidly decrease the cross-sectional area of the spout 36 as shown in dotted outline in FIG. 3 until no further discharge occurs. Of course, the pawl actuator portion 32 may be released at any time when a desired rate flow of material through the spout 36 is achieved whilst if greater flow is required, the cable 13 may simply be pulled out by hand to increase the loop size. Alternatively, the ratchet wheel 20 may be simply grasped by hand and rotated against the spring bias to permit the loop size to increase. For this purpose also, the reel assembly 12 may be provided with a handle so that the reel assembly 12 may be easily rotated against spring bias.

Whilst the apparatus has been described in relation to its use with flexible containers, it will be realized that it is suitable for many other applications wherein a gripping capacity by use of a tightening loop arises. Such areas may include animal fettering arrangements or other arrangements where objects are required to be gripped.

Preferably means are associated with the reel assembly 12 to lock the reel assembly 12 in a desired attitude to say prevent continuous tension being applied to the loop where for example damage to the object to be gripped is required to be minimised. This may simply be achieved by means of a locking pin 50 insertible through aligned holes in the bracket arms 15 and the ratchet wheel 20 or apertured disc 19.

In an alternative form of the invention, the biasing means may comprise a spring mounted on the support member 11 and arranged to directly apply a force to the flexible member 13 when released to decrease the size of the loop 14.

The present invention, therefore, provides a simple and effective means for tightening a loop about an object with exertion of minimum effort.

Whilst the above has been given by way of illustrative example of the invention, it will be realised that many modifications and variations as would be apparent to persons skilled in the art may be made to the above described embodiment without departing from the broad scope and ambit of the invention as defined by the appended claims.

I claim:

1. Apparatus adapted to be associated with a container of the type having a flexible discharge spout to control the discharge of granular material therefrom, said apparatus comprising an elongated member defining a handle portion at one end adapted to be gripped by one hand of a user, a flexible line having one end secured to the opposite end of said elongated member, said line passing freely through a guide at said opposite end of said elongated member to define a loop in said line adapted to be disposed in use about said discharge spout, a reel assembly supported on said elongated member intermediate the ends thereof, said reel assembly including a reel supported for rotation about an axis extending transversely of said elongated member, said line being secured at its opposite end to said reel so as to be wound in or let out upon rotation of said reel in opposite directions to thereby vary the size of said loop, biasing means associated with said reel and adapted to urge said reel to rotate in a first direction to wind in said line and thus reduce the size of said loop, a ratchet wheel fixed for rotation with said reel, a pawl assembly mounted adjacent said handle portion of said elongated member, biasing means associated with said pawl assembly to normally urge said pawl assembly into engagement with said ratchet wheel to prevent rotation of said reel in said first direction, said pawl assembly including an actuator portion located adjacent said handle portion so as to be releasably actuable by the hand of the user gripping the handle portion to effect controlled disengagement of said pawl assembly from said ratchet wheel so as to permit said reel under the influence of its biasing means to correspondingly rotate in said first direction to reduce the size of said loop and thereby selectively constrict in use the cross section of said discharge outlet of said container.

2. The apparatus according to claim 1, including locking means associated with said reel assembly to lock said reel against rotation.

3. A method of controlling the discharge of granular material from a container having a flexible discharge spout, said method comprising the steps of locating about said discharge spout the loop of an apparatus comprising an elongated member defining a handle portion at one end adapted to be gripped by one hand of a user, a flexible line having one end secured to the opposite end of said elongated member, said line passing freely through a guide at said opposite end of said elongated member to define said loop, a reel assembly supported on said elongated member intermediate the ends thereof about which said line may be wound to thereby vary the size of said loop, biasing means associated with said reel to urge said reel to rotate in a first direction to wind in said line and thus reduce the size of said loop, a ratchet wheel fixed for rotation with said reel, and a spring-biased pawl assembly mounted adjacent said handle portion to normally urge said pawl assembly into engagement with said ratchet wheel to prevent rotation of said reel and thereafter selectively actuating said pawl assembly by the hand of the user gripping said handle portion so as to permit said reel to reduce the size of said loop and thereby constrict in use said discharge outlet of said container.

* * * * *